US007337637B2

(12) United States Patent
Kan

(10) Patent No.: US 7,337,637 B2
(45) Date of Patent: Mar. 4, 2008

(54) COMBINATION RESETTING MEMBER FOR CABLE LOCK

(76) Inventor: Fuben Kan, 12-1 F. No. 112, Sec. 2, Chung Shan N. Rd., Taipei (TW)

( * ) Notice: Subject to any disclaimer, the term of this patent is extended or adjusted under 35 U.S.C. 154(b) by 0 days.

(21) Appl. No.: 11/428,576

(22) Filed: Jul. 5, 2006

(65) Prior Publication Data

US 2008/0006067 A1 Jan. 10, 2008

(51) Int. Cl.
*E05B 37/02* (2006.01)

(52) U.S. Cl. ..... 70/30; 70/317; 70/318; 70/327; 70/DIG. 75

(58) Field of Classification Search ..... 70/26, 70/30, 315–318, 323–328, 301, 304–312, 70/DIG. 21, DIG. 22, DIG. 75, DIG. 76
See application file for complete search history.

(56) References Cited

U.S. PATENT DOCUMENTS 1,472,206 A * 10/1923 Burkle ..... 70/30
1,511,119 A * 10/1924 Geraghty ..... 70/30
5,899,099 A * 5/1999 Tsai ..... 70/26
5,934,120 A * 8/1999 Kuo ..... 70/312
6,209,368 B1 * 4/2001 Lee ..... 70/312
6,386,005 B1 * 5/2002 Kuo ..... 70/28
6,422,051 B1 * 7/2002 Kuo ..... 70/312
6,711,922 B1 * 3/2004 Tsai ..... 70/312
6,799,446 B1 * 10/2004 Tsai ..... 70/30
6,845,643 B2 * 1/2005 Tsai ..... 70/312
2002/0104337 A1 * 8/2002 Kuo ..... 70/30

* cited by examiner

*Primary Examiner*—Lloyd A. Gall
(74) *Attorney, Agent, or Firm*—Leong C. Lei

(57) ABSTRACT

A combination resetting member for a cable lock mainly contains a stationary piece and a movable piece. The movable piece is concentrically positioned inside the stationary piece and two diametrically opposing pins penetrates through the stationary piece, two grooves of the movable piece, and into two corresponding holes on the tip of a column of a female lock member. The movable piece has two diametrically opposing flanges on the front surface and two diametrically opposing blocks on the back surface. The flanges and the blocks are orthogonal to each other. Corresponding to each of the blocks but on the front surface, there are a shallower U-shaped groove and a deeper U-shaped groove. The movable piece can be forced to move orthogonally to the pins and the pins therefore could shift from the shallower grooves to the deeper grooves and vice versa.

1 Claim, 2 Drawing Sheets

COMBINATION RESETTING MEMBER FOR CABLE LOCK

(a) TECHNICAL FIELD OF THE INVENTION

The present invention generally relates to cable locks, and more particularly to the combination resetting member of a cable lock.

(b) DESCRIPTION OF THE PRIOR ART

A cable lock ties the two ends of a steel cable together by a locking mechanism so that a bicycle or a motorcycle can be easily hooked to a stationary device for security.

A conventional cable lock usually has a resettable combination lock with a number of number wheels. To reset the combination, a number of techniques have already been disclosed. For example, in U.S. Pat. No. 6,209,368B1, a turn cap 27 (see the reference diagram of U.S. Pat. No. 6,209,368B1) is provided or, in U.S. Pat. No. 5,934,120, a toggle means 40 (see the reference diagram of U.S. Pat. No. 5,934,120) is provided.

All the prior approaches require a user to hold the lock in one hand and use the other hand for resetting the combination, which is quite inconvenient especially when the user has to carry stuffs in the mean time.

SUMMARY OF THE INVENTION

Accordingly, the present invention provides a combination resetting member for the cable locks which can be operated with a single hand.

The combination resetting member mainly contains a ring-shaped stationary piece and a ring-shaped movable piece, both installed to an threaded by the tip of a column of a female lock member.

The movable piece is concentrically wrapped inside the stationary piece and two diametrically opposing pins penetrates through the stationary piece, two grooves of the movable piece, and into two corresponding holes on the tip of a column of a female lock member. As such, the movable piece is confined by the pins inside the stationary piece. On the other hand, the stationary piece is fixedly positioned by the pins and confines the number wheels and a helix spring along the column of the female lock member.

The movable piece has two diametrically opposing flanges on the front surface and two diametrically opposing blocks on the back surface. The flanges and the blocks are orthogonal to each other. Corresponding to each of the blocks but on the front surface, there are a shallower U-shaped groove and a deeper U-shaped groove. The movable piece can be forced to move orthogonally to the pins and the pins therefore could shift from the shallower grooves to the deeper grooves and vice versa. When the pins are shifted to the shallower grooves, the number wheels are pushed back along the column of the female lock member and a new combination can be set.

The foregoing objectives and summary provide only a brief introduction to the present invention. To fully appreciate those and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
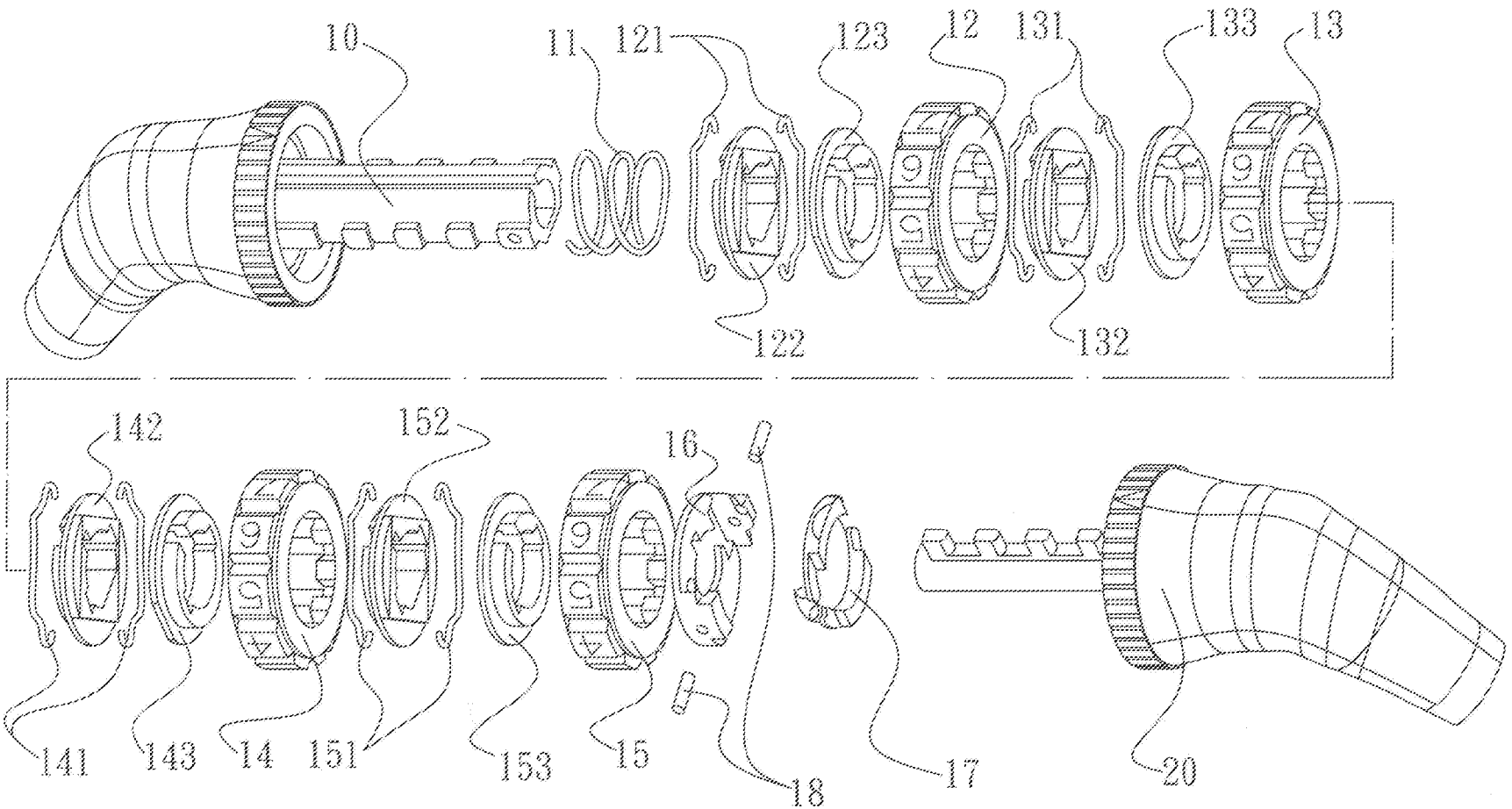
FIG. 1 is a perspective exploded view showing the various components of a cable lock according to an embodiment of the present invention.

FIG. 1 is a perspective exploded view showing the various components of the cable lock according to an embodiment of the present invention. As illustrated in FIG. 1, a helix spring 11 and four number wheels 12, 13, 14, and 15 are threaded in this order by a column of a female lock member 10 at an end of the cable lock. The cable lock has a male lock member 20 at the other end. For ease of reference, the terms "front" and "back" are used to referred to locations closer to or farther away from the tip of the column of the female lock member 10.

Figure 2:
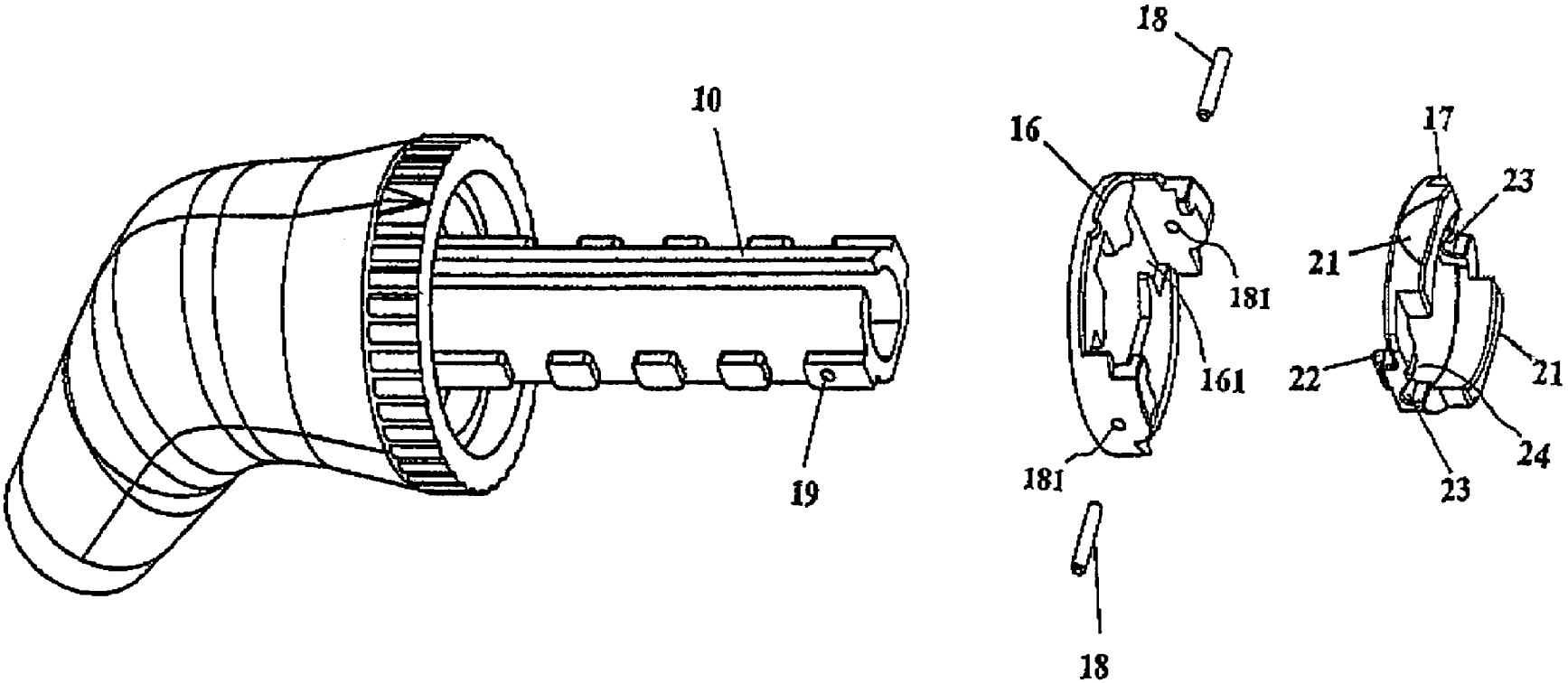
FIG. 2 is a perspective view showing the stationary and movable pieces of combination resetting member of the cable lock of FIG. 1.

As shown in FIG. 2, a combination resetting member is provided at the tip of the column of the female lock member 10. The combination resetting member contains a ring-shaped stationary piece 16 and a ring-shaped movable piece 17. The stationary piece 16 and the movable piece 17 are both threaded through by the column of the female lock member 10. The movable piece 17 is concentrically positioned inside the stationary piece 16.

The stationary piece 16 is then fixedly mounted around the tip of the column of the female lock member 10 by two diametrically opposing pins 18. The pins 18 run through two diametrically opposing holes 181 of the stationary piece 16, two diametrically opposing grooves on the front surface of the movable piece 17, and into two corresponding holes 19 at the tip of the column of the female lock member 10. As such, the helix spring 11 presses the number wheels 12, 13, 14 and 15 against the stationary piece 16 by its resilient force.

As shown both in FIGS. 1 and 2, the movable piece 17 has two diametrically opposing flanges 21 on the front surface and two diametrically opposing blocks 22 on the back surface. The flanges 21 and the blocks 22 are arranged orthogonally. Corresponding to each of the blocks 22 but on the front surface, the movable piece 17 has a shallower U-shaped groove 24 and a deeper U-shaped groove 23.

To reset the combination of the cable lock, the number wheels 12, 13, 14, and 15 are rotated for the original combination and the cable lock is opened. At this point the pins 18 are rested in the deeper grooves 23. A user holds the female lock member 10 in one hand and uses the thumb to press one of the flanges 21 to force the pins 18 to shift from the deeper grooves 23 into the shallower grooves 24 and thereby to produce a metallic clicking sound. In this way, the diametric force exerted by the thumb is turned into a front-to-back force. When the pins 18 shift into the shallower grooves 24, the blocks 22 on the back surface of the movable piece 17 stick through the notches 161 preset on the stationary piece 16 and force the number wheels 12, 13, 14, 15, along with their respective rings 123, 133, 143, and 153, pieces 122, 132, 142, and 152, and sets of spring hooks 121, 131, 141, and 151, to move backward. Finally, the helix spring 11 is compressed, and therefore the number wheels 12, 13, 14, and 15 can be twisted easily by the thumb to set a new combination. After the new combination is set, the user can use the thumb to press the other flange 21 so that the pins 18 shift back to the deeper grooves 23 and a metallic clicking sound is produced again. At this point, the new combination is set and the user can plug in the male lock member 20 into the female lock member 10 and scramble the number wheels 12, 13, 14, and 15. The two ends of the cable lock are then securely tied together.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. In a cable lock having a combination resetting member, the improvement wherein said combination resetting member comprises: a ring-shaped stationary piece threaded through and fixedly positioned to a tip of a column of a female lock member of said cable lock by at least two diametrically opposing pins penetrating through said stationary piece and into corresponding holes on the tip of said column; and a ring-shaped movable piece threaded through by the tip of said column and concentrically positioned inside said stationary piece, said movable piece being confined by said pins and being able to shift orthogonally to said pins, said stationary piece confining a helix spring and a plurality of number wheels along said column of said female lock member, said movable piece having at least two diametrically opposing flanges on a front surface and at least two diametrically opposing blocks on a back surface; said flanges and said blocks being orthogonal to each other; corresponding to each of said blocks but on the front surface, there are a shallower U-shaped groove and a deeper U-shaped groove; said movable piece being movable orthogonally to said pins and said pins being thereby able to shift from said shallower grooves to said deeper grooves and vice versa.

* * * * *